United States Patent [19]

Schaller et al.

[11] Patent Number: 4,855,647

[45] Date of Patent: Aug. 8, 1989

[54] FLASHLIGHT WITH SOFT TURN ON CONTROL

[75] Inventors: David R. Schaller, Janeville; El-Sayed Megahed, Madison, both of Wis.; Charles E. Samson, Walpole, Mass.

[73] Assignee: Rayovac Corporation, Madison, Wis.

[21] Appl. No.: 38,202

[22] Filed: Apr. 14, 1987

[51] Int. Cl.[4] ..... H05B 37/02

[52] U.S. Cl. ..... 315/209 R; 315/311

[58] Field of Search ..... 315/311, 209 R, 360, 315/208, 307, 49; 362/157

[56] References Cited

U.S. PATENT DOCUMENTS

| | | | |
|---|---|---|---|
| 2,247,198 | 6/1941 | Krefft et al. | 315/49 |
| 3,201,580 | 8/1965 | Moore | 362/157 |
| 3,612,945 | 10/1971 | Stevens | 315/200 R |
| 3,800,136 | 3/1974 | Edelson | 362/157 |
| 3,975,658 | 8/1976 | Emtage et al. | 315/311 |
| 4,499,525 | 2/1985 | Mallory | 315/307 |
| 4,570,108 | 2/1986 | Stroede et al. | 315/360 |
| 4,626,745 | 12/1986 | Davenport | 315/49 |

*Primary Examiner*—David K. Moore

*Attorney, Agent, or Firm*—Kenyon & Kenyon

[57] ABSTRACT

A flashlight is provided with a special circuit for limiting the surge current through the flashlight bulb. The circuit includes a secondary incandescent filament used to energize a transistor gradually upon the activation of flashlight. The transistor in turn gradually energizes the main bulb.

11 Claims, 2 Drawing Sheets

FLASHLIGHT WITH SOFT TURN ON CONTROL

BACKGROUND OF THE INVENTION

1. Field of Invention

This invention pertains to a flashlight with soft turn on control, and more particularly to a flashlight with circuit for limiting the surge or inrush current through an incandescent bulb thereof.

2. Description of the Prior Art

Typically, a flashlight has to be relatively small so that it can be hand-held and to minimize its storage space. Therefore the controls for the flashlight are made as simple as possible. Thus, a standard flashlight with a single incandescent bulb is normally provided with only a mechanical on/off switch for feeding current to the bulb from a power source such as one or more batteries. The bulb, switch and batteries are normally enclosed in a common housing. One problem which this arrangement is that the initial or surge current to the bulb is substantial. This large surge current (sometimes termed inrush current) seriously degrades the bulb because it imposes a large thermal and mechanical strain on its incandescent filament and switch contacts. This strain reduces the useful life of the bulb and often leads to its premature failure. For example, a bulb used in a flashlight which is activated frequently has a much shorter life than a bulb used in a flashlight which is activated only rarely even if the second flashlight is on for a longer time than the first flashlight. This problem is aggravated even further if the flashlight is provided with an activating switch with bounce, i.e. a switch which closes and opens several times in quick succession every time the switch is turned on. Thus a single activation of the switch causes several sequential current surges through the fillament in a relatively short time period.

SUMMARY OF THE INVENTION

In order to solve the above described problem, it is an objective of the present invention to provide a control circuit for a flashlight for limiting the surge current to its incandescent lamp.

A further objective is to provide a circuit which has a small number of components thereby minimizing the size and cost of the flashlight.

Other objectives and advantages of the invention shall become apparent from the following description of the invention. A flashlight in accordance with this invention comprises a housing which includes a power source, light generating means, activating means for selectively coupling the light generating means to the power source and a control circuit for limiting the surge current to the light generating means during initial activation. The control means includes, a switch element connected in series with said light generating means and a biasing network for activating the switch element gradually in response to said activating means. Preferably the biasing network includes a temperature-dependent variable resistance element.

DETAILED DESCRIPTION OF THE INVENTION

Figure 1A:
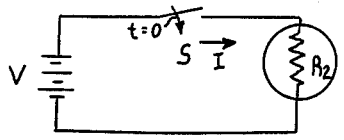
FIG.1A PRIOR ART
FIG. 1A shows a circuit for a typical prior art flashlight.
Figure 1B:
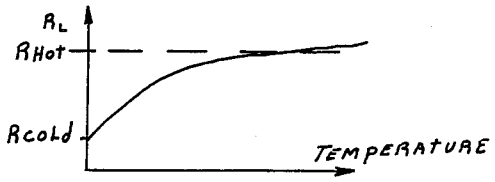
FIG.1B PRIOR ART
FIG. 1B shows the resistance of a typical incandescent bulb filament as a function of temperature.
Figure 1C:
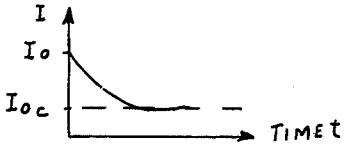
FIG.1C PRIOR ART
FIG. 1C shows the surge current through the fillament of the flashlight of FIG. 1.

FIGS. 1A–1C illustrate the surge current through a prior art flashlight filament. As previously explained, in a typical flashlight, batteries B generating a constant voltage V are merely connected in series with a switch S and a light bulb L having an incandescent fillament with a resistance R1. As shown in FIG. 1B, the initial resistance of the fillament, Rcold is relatively low. As a result when switch S is closed (at t=0), a very high surge current flows through the fillament. The value of the current, Io is given by:

$$Io = V/Rcold$$

As the filament heats up, its resistance R1 slowly rises toward a maximum value Rhot as shown in FIG. 1B, and the current I through the filament similarly decreases toward a constant value Idc.

According to the present invention, a flashlight is provided which includes a circuit for limiting the surge current through the filament. The components of the flashlight are shown, in a diagramatic form, in FIG. 2A. The circuit shown in this Figure includes batteries B which generate a constant voltage V, and which are in series with a primary bulb Lp with an incandescent filament having a resistance Rp, and a transistor T. There is also provided a biasing network comprising a resistor Rc in series with a manual switch S and a secondary bulb Ls having an incandescent fillament with a resistance Rs. The resistor Rc forms a voltage divider with the secondary bulb for controlling the transistor T as shown. The secondary bulb Ls is a high resistance low light output bulb such as a T3/4 or another similar bulb used for instrument panels. Such bulbs typically have a very long useful life. As shall be explained in more detail below, the present application increases the life of this bulb even farther.

The circuit operates as follows. When switch S is closed (at t=0), the cold resistance of bulb Ls is relatively low (as indicated in FIG. 1B). The value of Rc is selected so that initial voltage at the base of the transistor T, Vb is below the transistor turn-on threshold level and therefore no current flows through primary bulb Lp. For example if the cold resistance of bulb Rs is about 10 ohms and resistor Rc has a value of 47 ohms then for 1.5 volt batteries the initial voltage at the transistor base, Vo is:

$$Vo = 1.5(10/57) = 0.26 \text{ volts}$$

Figure 2A:
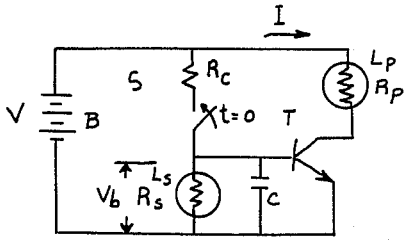
FIG. 2A shows a circuit for a flashlight constructed in accordance with this invention.

As the filament of the secondary bulb heats up, its resistance and, correspondingly, the voltage Vb, increases until Vb reaches a level Von (at a time ton) so that transistor T starts conducting. As the voltage Vb increases gradually after ton the transistor passes through its active region and the collector current I through the transistor and primary bulb rises gradually as shown in FIG. 2C. After transistor T reaches saturation, the current I may have a brief excursion above the steady state of final level Idc while the fillament of bulb Lp heat up, however it will never reach the surge levels indicated in FIG. 1C. Furthermore, if switch S bounces as it is closed, the effects of the bounce are eliminated by the transistor and the secondary light bulb by preventing the instantaneous high output current therethrough.

Figure 2B:
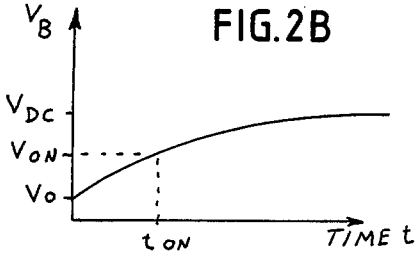
FIG. 2B shows the base voltage of the switching element for the circuit of FIG. 2A.
Figure 2C:
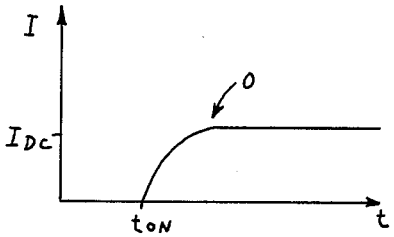
FIG. 2C shows the current through the primary fillament of FIG. 2A.

As shown in FIG. 2B, after t=ton, voltage continues to rise gradually until it reaches its final value Vdc which is dependent on the corresponding hot resistance of secondary bulb fillament Rs. For example, of the hot resistance of Rs is about 100 ohms, Vdc is:

$$Vdc = 1.5(100/147) = 1 \text{ volt.}$$

Preferably, secondary bulb Ls is selected so that its rating operating voltage is above Vdc. For Vdc=1 volt as described above, the operating voltage of Ls may be 1.5 volts. As a result, bulb Ls is operated below its rated voltage so that it will be barely on, and its light output will be at most minimal. As a result, bulb Ls will operate for a very long period of time without replacement. It is expected that the bulb may be operating up to 10,000 hours or more. Instead of a bulb, a capacitor may be used theoretically to achieve the results described above. From a practical view point this would be undesirable because the capacitor would have to have a value in excess of 10,000 microfarads. Such capacitors are very bulky, expensive and unreliable. However, the operation of the circuit may be slowed down by the use of an additional small capacitor C (having a value in order of one microfarad) connected in parallel with bulb Ls as shown in FIG. 2A. This capacitor would also assist in eliminating the effect of bouncing by switch S as described above.

Figure 3:
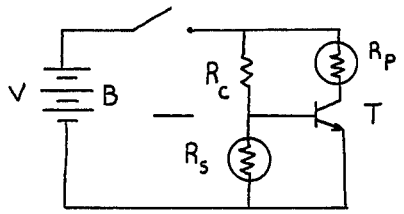
FIG. 3 shows an alternate embodiment of the invention.

One disadvantage of the circuit in FIG. 2A may be that a small leakage current may flow though the primary bulb Lp and transistor T even when the switch S is open, thereby draining the batteries. Therefore, it may be advantageous to put switch S in series with both the biasing network and the primary bulb Lp. Such a configuration is shown in FIG. 3. The two embodiments of FIGS. 2A and 3 both reduce switch contact wear.

Figure 5:
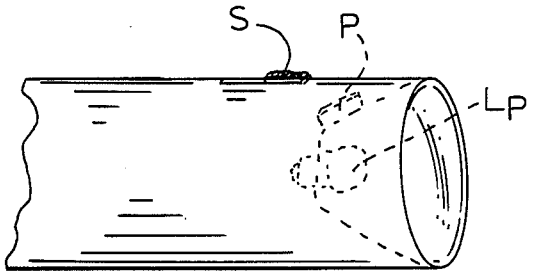
FIG. 5 shows a flashlight with the circuits of FIG. 2A or 3.

A flashlight with a circuit as shown in FIGS. 2A or 3 is shown in FIG. 5. The flashlight includes a housing H with a switch S, batteries B, a primary bulb Lp, and a control package P containing resistor Rc and transistor T. Capacitor C may also be included in the package, if necessary.

Physically the secondary bulb Ls may be provided as separate element within the control package P. In this configuration, the primary bulb Lp may be changed as required without affecting the rest of the control package.

Figure 4:
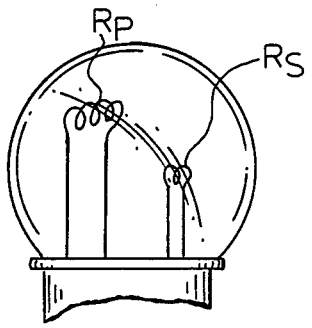
FIG. 4 shows two filaments in a common envelope.

Alternatively, the bulbs may be provided in a common envelope as shown in FIG. 4. In this configuration, the two bulbs are changed simultaneously.

Obviously, numerous changes may be made to this invention without departing from its scope as defined in the following claims.

We claim:

1. A flashlight comprising:

(a) a housing;

(b) a plurality of batteries disposed in said housing;

(c) a primary light bulb;

(d) a manual switch for selectively energizing said primary bulb with said batteries; and (e) control means responsive to said manual switch for controlling current flow through said primary light bulb, said control means being provided to reduce current inrush to said primary bulb, said control means including a transistor connected in series with said primary light bulb and a biasing network for controlling the operation of said transistor, said biasing network including a thermal resistance element.

2. The flashlight of claim 1 wherein said time variant resistance element includes a secondary light bulb.

3. A flashlight comprising;

(a) a primary light bulb;

(b) a manual switch for activating the light bulb from a power source;

(c) an electronic switch connected in series with said primary light bulb; and (d) a temperature variant resistant element for controlling said electronic switch, said element cooperating with said manual switch and said electronic switch to limit the surge current through said primary light bulb when said manual switch is activated.

4. The flashlight of claim 3 wherein said temperature variant resistance element is a secondary light bulb.

5. The flashlight of claim 4 wherein said electronic switch is a transistor.

6. The flashlight of claim 5 further comprising a resistor coupled with said secondary light bulb for biasing said transistor.

7. The flashlight of claim 6 wherein said secondary light bulb has a rated voltage and wherein after said primary light bulb is activated, said secondary light bulb is operated at a voltage below said rated voltage.

8. The flashlight of claim 6 wherein said primary and secondary bulbs are provided in separate envelopes.

9. The flashlight of claim 6 wherein said primary and secondary bulbs are provided in a common envelope.

10. The flashlight of claim 6 further comprising capacitive means for slowing the operation of said electronic switch.

11. A flashlight comprising:

(a) a housing;

(b) a power source disposed within said housing;

(c) primary light generating means;

(d) activating means for selectively connecting said power source to said primary light generating means; and (e) control means for controlling the initial current surge through said primary light generating means resulting from said activation, said control circuit including an electronic switch and biasing means for controlling the current flow through said electronic switch, said biasing means including a time-variant resistance element.

* * * * *

UNITED STATES PATENT AND TRADEMARK OFFICE

CERTIFICATE OF CORRECTION

PATENT NO. : 4,855,647

DATED : August 8, 1989

INVENTOR(S) : David R. Schaller, et al.

It is certified that error appears in the above-identified patent and that said Letters Patent is hereby corrected as shown below:

| Column | Line | |
|---|---|---|
| 2 | 38 | Delete "diagramatic" and insert --diagrammatic--. |
| 3 | 17 | Delete "of", second occurrence and insert --if--. |
| 4 | 28 | Delete "resistant" and insert --resistance--. |

Signed and Sealed this

Fourth Day of December, 1990

*Attest:*

HARRY F. MANBECK, JR.

*Attesting Officer*

*Commissioner of Patents and Trademarks*